US012256801B2

(12) United States Patent
Vestuti et al.

(10) Patent No.: US 12,256,801 B2
(45) **Date of Patent: *Mar. 25, 2025**

(54) ARTICLE OF FOOTWEAR WITH DISPENSED SADDLE

(71) Applicant: REEBOK INTERNATIONAL LIMITED, Altrincham (GB)

(72) Inventors: Ricardo Vestuti, Providence, RI (US); Brian Christensen, Centerville, MA (US); Dennis Gaboriault, Millbury, MA (US); Henry Hardigan, Pawtucket, RI (US)

(73) Assignee: Reebok International Limited, Altrincham (GB)

( * ) Notice: Subject to any disclaimer, the term of this patent is extended or adjusted under 35 U.S.C. 154(b) by 0 days.

This patent is subject to a terminal disclaimer.

(21) Appl. No.: 18/074,252

(22) Filed: Dec. 2, 2022

(65) Prior Publication Data

US 2023/0100560 A1 Mar. 30, 2023

Related U.S. Application Data

(63) Continuation of application No. 15/831,851, filed on Dec. 5, 2017, now abandoned.

(51) Int. Cl.
*B29D 35/14* (2010.01)
*A43B 23/02* (2006.01)

(52) U.S. Cl.
CPC ..... *A43B 23/028* (2013.01); *A43B 23/0225* (2013.01); *A43B 23/0235* (2013.01); *A43B 23/0245* (2013.01); *A43B 23/0255* (2013.01)

(58) Field of Classification Search
CPC . B29D 35/146; A43B 23/028; A43B 23/0225; A43B 23/0235; A43B 23/0245; A43B 23/0255
See application file for complete search history.

(56) References Cited

U.S. PATENT DOCUMENTS

| | | | |
|---|---|---|---|
| 2,100,492 | A | 11/1937 | Sindler |
| 2,325,656 | A | 8/1943 | Brophy |
| 3,251,728 | A | 5/1966 | Humbert et al. |
| 3,719,965 | A | 3/1973 | Chevallereau |
| 4,272,898 | A | 6/1981 | Tansill |
| 4,272,989 | A | 6/1981 | Rymarchyk et al. |
| 4,431,311 | A | 2/1984 | Kolossow |
| 4,536,974 | A | 8/1985 | Cohen |
| 4,593,482 | A | 6/1986 | Mayer |

(Continued)

FOREIGN PATENT DOCUMENTS

| | | | |
|---|---|---|---|
| CN | 1066620 | C | 6/2001 |
| CN | 101820788 | A | 9/2001 |

(Continued)

*Primary Examiner* — Robert B Davis
(74) *Attorney, Agent, or Firm* — Sterne, Kessler, Goldstein & Fox P.L.L.C.

(57) ABSTRACT

A method of manufacturing an article of footwear includes forming an upper dispensed component by dispensing material over an upper for an article of footwear. The upper dispensed component includes a bonded segment that bonds to the article of footwear and a non-bonded segment that does not bond to the article of footwear. The non-bonded segment is dispensed over a non-stick material.

20 Claims, 9 Drawing Sheets

(56) References Cited

U.S. PATENT DOCUMENTS

| | | | | |
|---|---|---|---|---|
| 4,611,412 | A | 9/1986 | Cohen | |
| 4,753,021 | A | 6/1988 | Cohen | |
| 4,754,559 | A | 7/1988 | Cohen | |
| 4,952,450 | A | 8/1990 | Noel | |
| 5,063,018 | A | 11/1991 | Fontirroche et al. | |
| 5,233,767 | A | 8/1993 | Kramer | |
| 5,713,140 | A | 2/1998 | Baggenstoss | |
| 5,916,006 | A | 6/1999 | Ganson | |
| 6,280,478 | B1 | 8/2001 | Richter et al. | |
| 6,782,642 | B2 | 8/2004 | Knoche et al. | |
| 7,192,069 | B1 | 3/2007 | Daniel | |
| 7,444,768 | B2 | 11/2008 | Friton | |
| 7,926,204 | B2 | 4/2011 | Ungari et al. | |
| 8,065,818 | B2 * | 11/2011 | Greene | A43B 23/26 12/142 E |
| 8,993,061 | B2 | 3/2015 | Jones et al. | |
| 9,474,331 | B2 * | 10/2016 | Waatti | A43B 23/0235 |
| 10,568,387 | B2 * | 2/2020 | Christensen | A43B 13/127 |
| 2003/0159312 | A1 | 8/2003 | Farys et al. | |
| 2004/0181974 | A1 | 9/2004 | Robinson et al. | |
| 2006/0288612 | A1 | 12/2006 | Lucas et al. | |
| 2007/0170610 | A1 | 7/2007 | Payne et al. | |
| 2007/0180730 | A1 | 8/2007 | Greene et al. | |
| 2007/0266593 | A1 | 11/2007 | Schindler et al. | |
| 2008/0271339 | A1 | 11/2008 | Fischer | |
| 2009/0013558 | A1 | 1/2009 | Hazenberg et al. | |
| 2009/0094858 | A1 | 4/2009 | Ungari et al. | |
| 2009/0126225 | A1 | 5/2009 | Jarvis | |
| 2009/0229144 | A1 | 9/2009 | Sussman | |
| 2009/0247658 | A1 | 10/2009 | Kobayashi et al. | |
| 2011/0016746 | A1 | 1/2011 | Callahan et al. | |
| 2011/0113648 | A1 | 5/2011 | Leick et al. | |
| 2011/0154584 | A1 | 6/2011 | Ungari et al. | |
| 2011/0197475 | A1 | 8/2011 | Weidl et al. | |
| 2011/0232130 | A1 | 9/2011 | Boudreau et al. | |
| 2011/0258876 | A1 | 10/2011 | Baker et al. | |
| 2012/0011744 | A1 | 1/2012 | Bell et al. | |
| 2012/0180344 | A1 | 7/2012 | Crowley et al. | |
| 2012/0198730 | A1 | 8/2012 | Burch et al. | |
| 2013/0104422 | A1 | 5/2013 | Hatfield et al. | |
| 2013/0145650 | A1 | 6/2013 | Seo | |
| 2013/0260104 | A1 | 10/2013 | Dua et al. | |
| 2014/0020192 | A1 | 1/2014 | Jones et al. | |
| 2014/0230276 | A1 | 8/2014 | Campos, II et al. | |
| 2015/0013187 | A1 | 1/2015 | Taniguchi et al. | |
| 2015/0040428 | A1 | 2/2015 | Davis et al. | |
| 2016/0192741 | A1 | 7/2016 | Mark | |
| 2016/0213096 | A1 | 7/2016 | Borel et al. | |
| 2016/0219982 | A1 | 8/2016 | Waatti | |
| 2016/0262494 | A1 | 9/2016 | Weidl | |
| 2016/0366978 | A1 | 12/2016 | Holt | |
| 2017/0013916 | A1 | 1/2017 | Too-A-Foo | |
| 2017/0135439 | A1 | 5/2017 | Davis et al. | |
| 2017/0208900 | A1 | 7/2017 | Boucher et al. | |
| 2017/0231319 | A1 | 8/2017 | Bohnsack et al. | |
| 2017/0280817 | A1 | 10/2017 | Hutchinson et al. | |
| 2017/0340064 | A1 | 11/2017 | Boucher et al. | |
| 2018/0104922 | A1 * | 4/2018 | Büsgen | B33Y 10/00 |
| 2018/0146744 | A1 * | 5/2018 | Guest | A43B 13/148 |
| 2018/0339478 | A1 * | 11/2018 | Lee | B33Y 40/10 |
| 2019/0008234 | A1 | 1/2019 | Christensen et al. | |
| 2019/0037970 | A1 * | 2/2019 | Klug | A43B 23/0235 |
| 2019/0053569 | A1 | 2/2019 | Johnson et al. | |
| 2020/0046062 | A1 * | 2/2020 | Perillo | A43B 3/12 |

FOREIGN PATENT DOCUMENTS

| | | | |
|---|---|---|---|
| CN | 1817261 | A | 8/2006 |
| CN | 101478893 | A | 7/2009 |
| CN | 202760295 | U | 3/2013 |
| CN | 103153109 | A | 6/2013 |
| CN | 106942830 | A | 7/2017 |
| DE | 1279314 | B | 10/1968 |
| EP | 0130816 | A2 | 1/1985 |
| EP | 1430801 | A1 | 6/2004 |
| EP | 2684479 | A2 | 1/2014 |
| WO | 9703582 | A1 | 2/1997 |
| WO | 2009057107 | A2 | 5/2009 |
| WO | 2017083013 | A1 | 5/2014 |
| WO | 2014100462 | A1 | 6/2014 |
| WO | 2015176813 | A1 | 11/2015 |

* cited by examiner

ARTICLE OF FOOTWEAR WITH DISPENSED SADDLE

CROSS-REFERENCE TO RELATED APPLICATIONS

This application is a continuation of U.S. patent application Ser. No. 15/831,851, filed Dec. 5, 2017, which is incorporated by reference herein in its entirety.

BACKGROUND

Field

Embodiments of the present invention relate generally to articles of footwear; and more specifically to articles of footwear with dispensed components.

Background

Articles of footwear are used to protect and cushion the wearer's feet. Because articles of footwear may be worn for an extended period of time, consumers desire articles of footwear that will fit properly to secure the article of footwear to the wearer's foot in a comfortable manner. It is desirable to achieve improved fit for articles of footwear in an efficient manner.

BRIEF SUMMARY

Articles of footwear with dispensed components are disclosed. The components may be formed via an automated dispensing process that is done robotically. In some embodiments, an article of footwear includes a sole, an upper, and a dispensed component. In some embodiments, the upper is coupled to the sole and includes an instep. In some embodiments, the dispensed component extends over the instep from a medial side of the upper to a lateral side of the upper.

In some embodiments, the dispensed component forms a saddle. In some embodiments, the dispensed component extends over the instep from a medial featherline of the article of footwear to a lateral featherline of the article of footwear. In some embodiments, the dispensed component is not bonded to the upper between the medial featherline and the lateral featherline. In some embodiments, the dispensed component is not bonded to the instep. In some embodiments, the dispensed component is partially bonded to the upper (e.g., bonded between the medial featherline and the instep and between the lateral featherline and the instep, but not bonded across the instep). In some embodiments, the dispensed component is bonded to a medial featherline of the article of footwear and a lateral featherline of the article of footwear.

In some embodiments, the dispensed component extends along the medial featherline for at least 50% of a longitudinal length of the sole. In some embodiments, the dispensed component extends along the lateral featherline for at least 50% of a longitudinal length of the sole.

In some embodiments, the dispensed component can secure the article of footwear to a wearer's foot. In some embodiments, the dispensed component can stretch. In some embodiments, the dispensed component defines a plurality of apertures.

In some embodiments, the upper is a bootie. In some embodiments, the bootie is a single layer bootie. In some embodiments, the upper may be any suitable upper. The upper may be made of a variety of materials (e.g., a textile fabric, woven or knit goods, leather, synthetic, a film product, etc.). In some embodiments, the upper may be made of a combination of these materials.

In some embodiments, an article of footwear includes an upper and a sole coupled to the upper. In some embodiments, the sole includes a midsole, a substrate attached to the midsole, and a dispensed component disposed on the substrate.

In some embodiments, the substrate is attached to the midsole with a hot melt film. In some embodiments, the substrate is attached to the midsole with any type of adhesive system (e.g., solvent-based or water-based urethane cement). In some embodiments, the substrate includes a synthetic coating. In some embodiments, the substrate includes a textile. In some embodiments, the substrate includes a textile with a thin film laminate backing or cast film coating. In some embodiments, the substrate includes a thermoplastic polyurethane film (e.g., mono-layer film, co-extruded film, multi-layer film) or other suitable polymeric film.

In some embodiments, the substrate can bond with the dispensed component as the dispensed component solidifies. In some embodiments, the dispensed component forms an outsole of the sole. In some embodiments, the midsole includes foam.

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION

Figure 1:
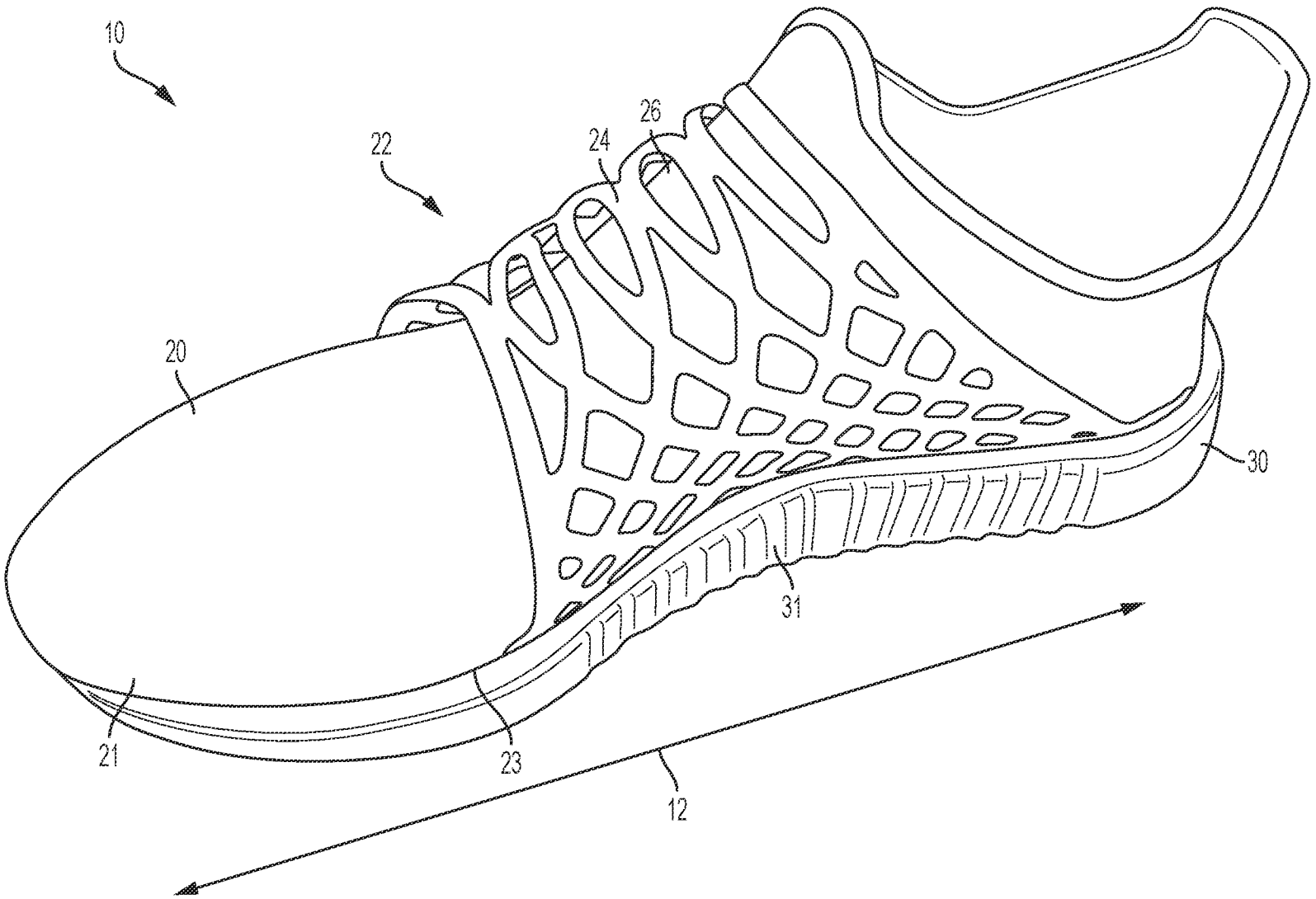
FIG. 1 shows a perspective view of an article of footwear according to some embodiments.
Figure 2:
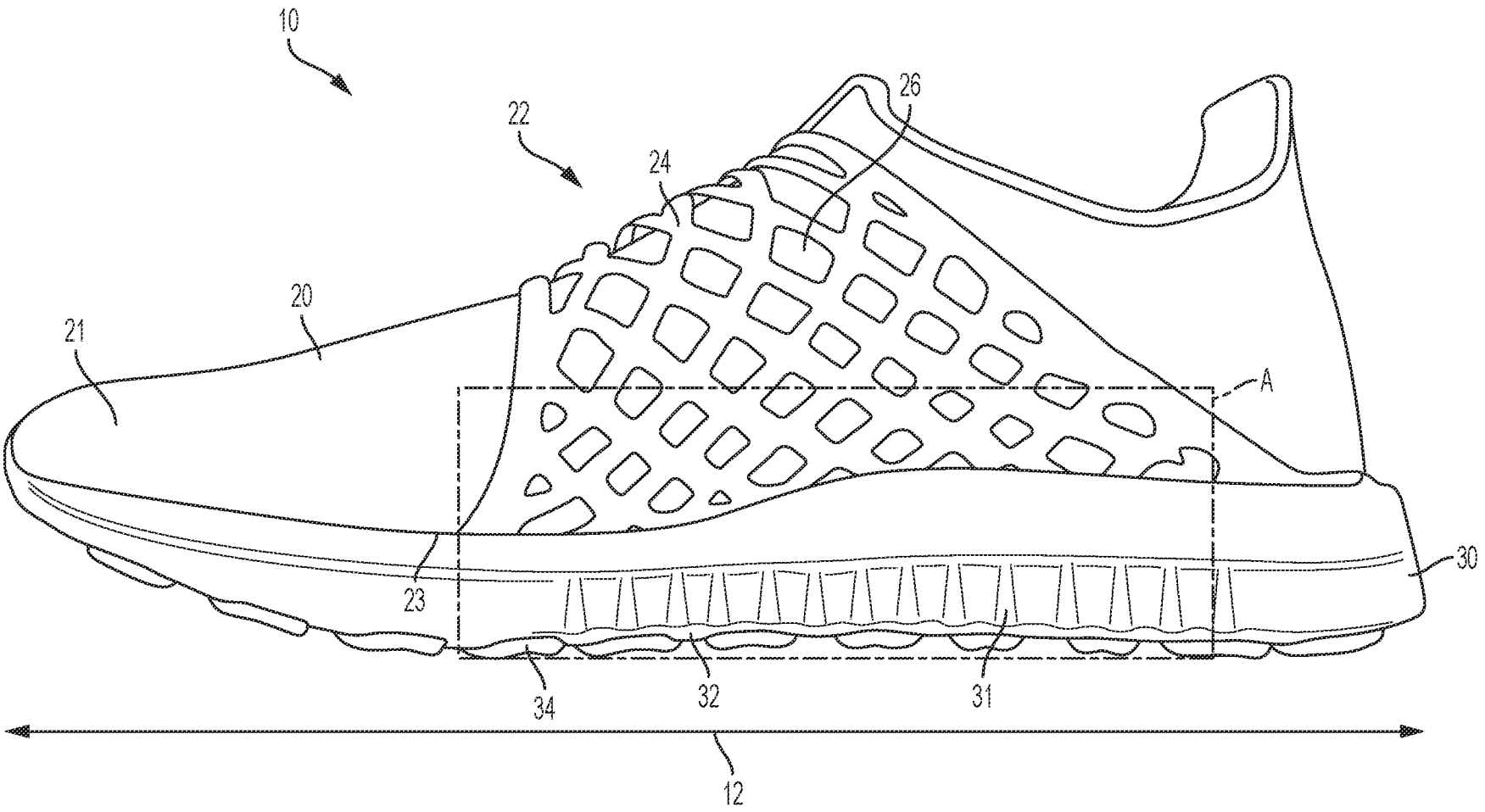
FIG. 2 shows a medial side view of an article of footwear according to some embodiments.

The present invention will now be described in detail with reference to embodiments thereof as illustrated in the accompanying drawings, in which like reference numerals are used to indicate identical or functionally similar elements. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The term "invention" or "present invention" as used herein is a non-limiting term and is not intended to refer to any single embodiment of the particular invention but encompasses all possible embodiments as described in the application.

The following examples are illustrative, but not limiting, of the present invention. Other suitable modifications and adaptations of the variety of conditions and parameters normally encountered in the field, and which would be apparent to those skilled in the art, are within the spirit and scope of the invention.

Embodiments of the present invention provide articles of footwear having one or more dispensed components created by an automated dispensing process. It is understood that while the term "dispensed" is generally used herein to refer to certain materials, these materials may also be "extruded." Thus, the term "dispensed component" includes components that are dispensed and components that are extruded. These dispensed components may be dispensed from a mechanical device. In some embodiments, the dispensed components are 3-D printed. In some embodiments, the dispensed components are not 3-D printed.

In some embodiments, an upper and/or a sole of the article of footwear may have one or more dispensed components. In some embodiments, an upper and/or a sole, or portions thereof, can be formed from one or more dispensed components. In some embodiments, the dispensed component can be a single, continuous piece of solid material. A dispensed footwear component can have advantages over traditionally-formed components, such as those made by casting, pouring, injection molding, screen-printing, or thermo-plastically forming. For example, a dispensed component can be customized without having to machine a new, expensive mold. The use of dispensed components can also allow for the use of shapes and geometries that are difficult to achieve using conventional upper or bottom molding techniques. Moreover, the data and knowledge to make a dispensed component can be quickly deployed to any location that houses equipment and material suitable for processing.

Various physical properties of the dispensed component can be manipulated, adjusted, altered, and/or modified. For example, in some embodiments, the width, length, shape, wall thickness, color, density, elasticity, material, viscosity, hardness, number of layers, etc. of the dispensed component can vary along the dispensed component or between a first and second dispensed component. As an example, a dispensed component on an upper may be less viscous than a dispensed component on a sole, which can help the dispensed component on the upper lay flat. As another example, a dispensed upper component may be rigid in a first portion, flexible in a second portion that is continuous with the first portion, and rigid in a third portion that is continuous with the second portion. The dispensed upper component may similarly vary in other characteristics, such as color or in the number of layers.

In some embodiments, the dispensed component can be made of rubber, foam (e.g., dispensed polyurethane foam), silicone, plastic including thermoplastic (e.g., polyurethane (such as TPU), nylon, or polypropylene), or any other suitable material. In some embodiments, the dispensed component can be made of a composite material. In some embodiments, the cross-section of the dispensed component can be substantially circular, oval, rectangular, triangular, square, or any other suitable shape or design (e.g., star-shaped). In some embodiments, the cross-section of the dispensed component can be relatively flat (i.e., low profile). Moreover, the cross-section of the dispensed component may be adjusted dynamically and may vary throughout the automated dispensing process.

In some embodiments, the dispensed component can be dispensed directly onto the article of footwear, such as directly onto the sole (e.g., insole, midsole, and/or outsole) or the upper. For example, the dispensed component can be dispensed directly onto a formed upper on a last (e.g., a flat knit upper, a circular knit upper, a formed three-dimensional knit, a sock, a fully-finished traditionally-lasted upper, etc.). The upper may be made of a textile fabric, leather, synthetic, or film product. In some embodiments, the dispensing or extruding is done automatically (i.e., robotically). In some embodiments, a scanner may scan the upper and then robotically dispense the dispensed component onto the upper based on the scan.

In some embodiments, the dispensed component may bond (e.g., by thermal fusion, chemical adhesion, or mechanical locking) to a portion of the article of footwear. In some embodiments, a portion of the dispensed component may bond to the article of footwear, while another portion of the dispensed component does not bond to the article of footwear.

In some embodiments, the dispensed component may form an upper support element for the article of footwear. For example, in some embodiments, the dispensed component may form a saddle. In some embodiments, the saddle extends over the instep of the article of footwear. In some embodiments, the saddle is not bonded to the article of footwear over the instep. In some embodiments, the saddle is bonded to the article of footwear at the medial featherline and the lateral featherline. The saddle may help secure the article of footwear to the wearer's foot. In some embodiments, the dispensed component that forms the saddle provides for some stretch, which may facilitate a more comfortable fit around the wearer's foot.

In some embodiments, the dispensed component may form a portion of the sole of the article of footwear. In some embodiments, the dispensed component may form an outsole (i.e., a ground-contacting surface) of the article of footwear. In some embodiments, the sole comprises a foam midsole. In some embodiments, a substrate is disposed underneath the foam midsole. The substrate may be bonded to the foam midsole with an adhesive, such as a hot melt film, or traditionally cemented by way of solvent-based or water-based urethane adhesive. In some embodiments, the substrate provides a suitable surface for bonding with the dispensed component. In some embodiments, the dispensed component is dispensed onto the substrate, for example, in an undulating pattern, to form the outsole. Forming the sole with a dispensed component may provide flexibility and speed in development and manufacturing of the sole.

In some embodiments, the article of footwear may include or utilize any of the extruded/dispensed components or other features disclosed in U.S. application Ser. No. 14/455,650, filed Aug. 8, 2014, U.S. application Ser. No. 14/945,077, filed Nov. 18, 2015, and/or U.S. application Ser. No. 15/644,463, filed Jul. 7, 2017, the disclosures of which are incorporated herein in their entireties by reference thereto.

In some embodiments, dispensed components may be utilized in article of footwear 10, as shown, for example, in FIGS. 1-6. In some embodiments, article of footwear 10 comprises an upper 20 and a sole 30. In some embodiments, upper 20 and sole 30 are coupled together. In some embodiments, article of footwear 10 comprises an upper dispensed component 24, as shown, for example, in FIG. 1. In some embodiments, article of footwear 10 comprises a sole dispensed component 34, as shown, for example in FIG. 2. In some embodiments, article of footwear 10 comprises both a sole dispensed component 34 and an upper dispensed component 24 (see FIG. 2). However, in some embodiments, article of footwear 10 may include either sole dispensed component 34 or upper dispensed component 24, and not both.

In some embodiments, dispensed components 24, 34 may be dispensed onto a surface so as to provide a dispensed component that extends above the surface at a certain width and height profile. In some embodiments, the height, width, or geometry or physical appearance/characteristic of the dispensed components may be dynamically changed as the components are dispensed onto article of footwear 10, such as onto sole 30, or another surface. In some embodiments, the geometry or physical appearance/characteristics of the dispensed components may be changed by dynamically changing the height of the nozzle (relative to the dispensing surface or substrate) from which the material, used to form the component, is dispensed. In some embodiments, the geometry or physical appearance/characteristics of the dispensed components may be changed by dynamically changing the speed at which the nozzle is moving as the material is dispensed and the component is formed. In some embodiments, the geometry or physical appearance/characteristics of the dispensed components may be changed by dynamically changing the flow rate of the material that is dispensed. Other parameters may be changed to dynamically change the height, width, or other characteristic of the dispensed components. In some embodiments, the density or viscosity of the dispensed components may be changed.

Upper 20 may be made of a variety of materials (e.g., a textile fabric, woven or knit goods, leather, synthetic, a film product, etc.). In some embodiments, upper 20 may be made of a combination of these materials. In some embodiments, upper 20 comprises a bootie 21, as shown, for example, in FIG. 1. In some embodiments, bootie 21 comprises a single-layer bootie. In some embodiments, upper 20 comprises an elastic material. Using an elastic material in upper 20 may allow upper 20 to stretch and conform to a wearer's foot. In some embodiments, upper 20 includes an instep 22. In some embodiments, instep 22 is a continuous portion of upper 20, as shown in FIG. 1. In some embodiments, instep 22 may be a tongue. In some embodiments, at least a portion of instep 22 may include a gap in the material of upper 20.

In some embodiments, upper dispensed component 24 extends over instep 22. In some embodiments, upper dispensed component 24 extends from a medial side of article of footwear 10 to a lateral side of article of footwear 10. In some embodiments, upper dispensed component 24 extends from a medial featherline 23 of article of footwear 10 to a lateral featherline 25 of article of footwear 10.

Figure 3:
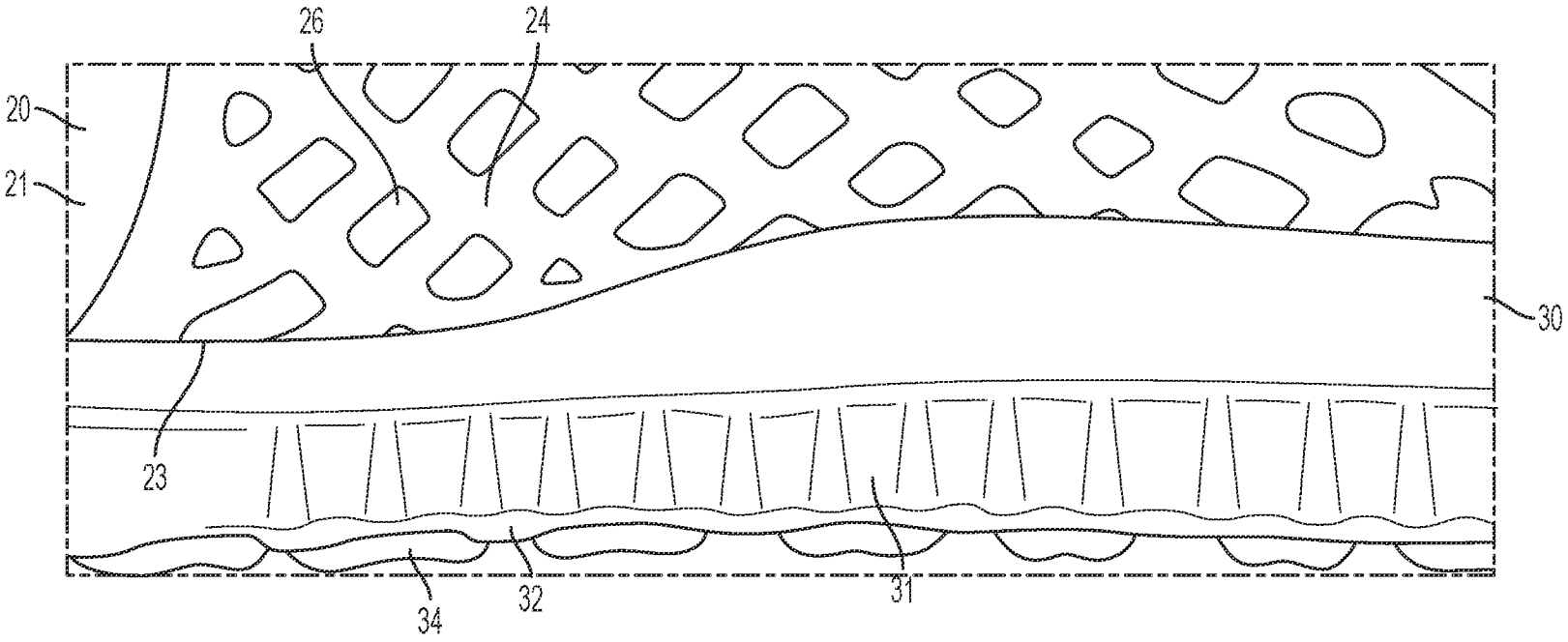
FIG. 3 shows a close-up view of portion A of the article of footwear of FIG. 2 according to some embodiments.

In some embodiments, upper dispensed component 24 is bonded to article of footwear 10 at medial featherline 23 (see FIG. 3). In some embodiments, dispensed component 24 is bonded to article of footwear 10 at lateral featherline 25. In some embodiments, dispensed component 24 is bonded to article of footwear 10 at medial featherline 23 and lateral featherline 25. In some embodiments, upper dispensed component 24 is not bonded to article of footwear 10 at instep 22. In some embodiments, upper dispensed component 24 is not bonded to upper 20 at any point between medial featherline 23 and lateral featherline 25.

Thus, in some embodiments, a segment of upper dispensed component 24 may bond or stick to article of footwear 10 (e.g., at medial featherline 23 and/or lateral featherline 25) and another segment of upper dispensed component 24 may not bond or stick to article of footwear 10 (e.g., at instep 22). In some embodiments, having a bonded segment and a non-bonded segment of upper dispensed component 24 allows a designated part of article of footwear 10 (e.g., bootie 21, instep 22, etc.) to stretch and move independently from upper dispensed component 24 (see FIG. 4). In some embodiments, the non-bonded segment of upper dispensed component 24 may extend over a gap in the material of upper 20. In some embodiments, the non-bonded segment of upper dispensed component 24 may extend over a tongue of upper 20. For example, upper dispensed component 24 may be bonded to article of footwear 10 on both a medial side and a lateral side (e.g., at the feather line, at the quarters, etc.) and include a non-bonded segment that extends over a tongue of upper 20. In some embodiments, the non-bonded segment of upper dispensed component 24 may extend over a portion of upper 20 to provide stress relief.

In some embodiments, to form the non-bonded segment of upper dispensed component 24, the component is dispensed over a non-stick material. A non-stick material is any material that does not bond with upper dispensed component 24 as it hardens. In some embodiments, the non-stick material may be removed after upper dispensed component 24 has hardened, thus leaving a non-bonded segment of the dispensed component. In some embodiments, the non-stick material may be a temporary insert made from polytetrafluoroethylene (PTFE), or other suitable non-stick material. In some embodiments, the non-stick material may be screen printed or sprayed over a portion of article of footwear 10, such as a portion of instep 22. In some embodiments, a last on which upper dispensed component 24 is dispensed may be made of or coated with the non-stick material. In some embodiments, article of footwear 10 may have an upper 20 that is completely knit (e.g., flat knit, circular knit, etc.) with areas of the knit upper comprising yarns that are inherently non-stick (e.g., PTFE yarns, polyolefin yarns, ultra-high-molecular-weight polyethylene (UHMWPE) yarn). In some embodiments, upper 20 may include woven, non-woven, or knit sections that are entirely made from non-stick yarns that are seamed together (i.e., stitched) to other sections that are made from traditional yarns (i.e., polyester, nylon, etc.) that may or may not be coated with the non-stick material.

Figure 7:
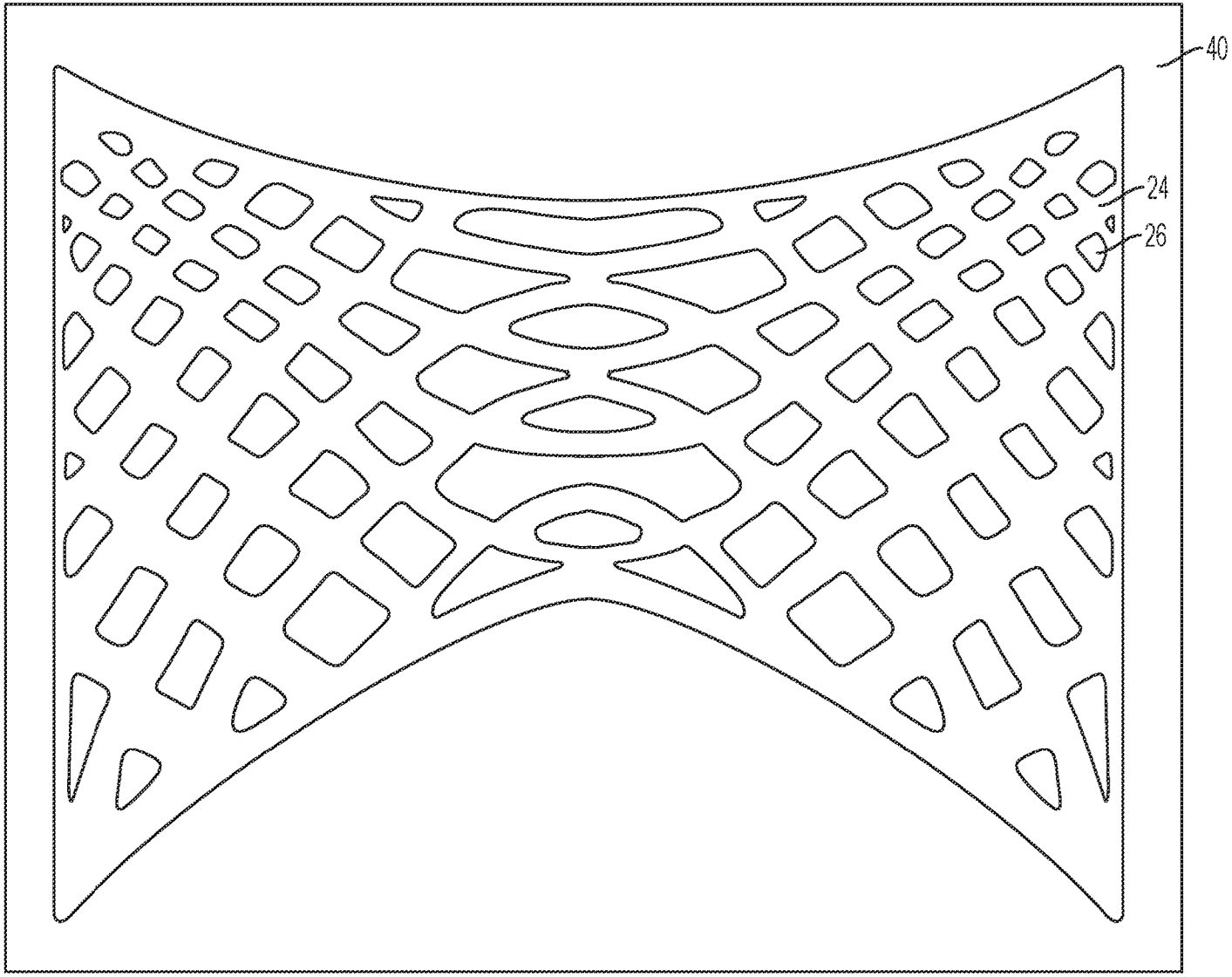
FIG. 7 shows a top view of an upper dispensed component on a substrate according to some embodiments.

In some embodiments, an entire upper dispensed component 24 may be made as a non-bonded segment (i.e., upper dispensed component 24 is dispensed only over a non-stick material to form a stand-alone component). For example, upper dispensed component 24 may be dispensed to a substrate 40, as shown, for example, in FIG. 7. In some embodiments, substrate 40 comprises a non-stick material, such that upper dispensed component 24 will form a free-floating or stand-alone component. In some embodiments, upper dispensed component 24 is dispensed to define a plurality of apertures 26. The appearance (e.g., color) and/or mechanical properties (e.g., cross-section, material properties, aperture design, etc.) of upper dispensed component 24 as a stand-alone component may vary in different areas to affect the relative strain. In some embodiments, upper dispensed component 24 may then be attached to article of footwear 10. For example, upper dispensed component 24 may be attached to article of footwear 10 as a saddle with attachment points located at medial featherline 23 and lateral featherline 25. In some embodiments, upper dispensed component 24 may be attached to article of footwear 10 between upper 20 and sole 30.

In some embodiments, upper dispensed component 24 may be attached to article of footwear 10 at locations other than medial featherline 23 and lateral featherline 25. In some embodiments, upper dispensed component 24 may be attached to a portion of upper 20 of article of footwear 10. In some embodiments, upper dispensed component 24 may be attached to a portion of sole 30 of article of footwear 10. In some embodiments, upper dispensed component 24 may be attached to any other part of article of footwear 10 (e.g., between sole 30 and upper 20).

In some embodiments, upper dispensed component 24 is stitched to article of footwear 10. In some embodiments, upper dispensed component 24 may be stitched along medial featherline 23 and/or lateral featherline 25. In some embodiments, upper dispensed component 24 is stitched to upper 20 (e.g., a bottom surface of upper 20). In some embodiments, upper dispensed component 24 is stitched to sole 30 (e.g., a top surface of sole 30). In some embodiments, upper dispensed component 24 is stitched between sole 30 and upper 20.

In some embodiments, upper dispensed component 24 is adhered to article of footwear 10 with an adhesive. In some embodiments, upper dispensed component 24 bonds to article of footwear 10 as upper dispensed component 24 hardens or solidifies. Other means of joining may also be used (e.g., laser-welded, ultrasonically welded, radio-frequency welded, low-melt film, or any other suitable method for joining).

In some embodiments, upper dispensed component 24 extends along medial featherline 23 in a longitudinal direction 12. In some embodiments, upper dispensed component 24 extends along medial featherline 23 for at least 25% of the length of medial featherline 23. In some embodiments, upper dispensed component 24 extends along medial featherline 23 for at least 50% of the length of medial featherline 23.

In some embodiments, upper dispensed component 24 extends along lateral featherline 25 in longitudinal direction 12. In some embodiments, upper dispensed component 24 extends along lateral featherline 25 for at least 25% of the length of lateral featherline 25. In some embodiments, upper dispensed component 24 extends along lateral featherline 25 for at least 50% of the length of lateral featherline 25.

In some embodiments, upper dispensed component 24 forms a saddle for upper 20. In some embodiments, upper dispensed component 24 secures article of footwear 10 to a wearer's foot. In some embodiments, upper dispensed component 24 may be elastic. In some embodiments, upper dispensed component 24 may be less elastic than upper 20. Thus, upper 20 and upper dispensed component 24 may stretch to accommodate the wearer's foot, while upper dispensed component 24 provides an outer boundary of stretching to better secure article of footwear 10 to the wearer's foot.

In some embodiments, upper dispensed component 24 defines a plurality of apertures 26. In some embodiments, apertures 26 form a grid pattern. In some embodiments, the size, shape, and/or pattern of apertures 26 varies in different portions of upper dispensed component 24. For example, apertures 26 may be smaller in the medial and/or lateral sides of article of footwear 10 than on the top of instep 22. This configuration may provide more support to the side of a wearer's foot, thus facilitating upper dispensed component 24 to function as a saddle. Other changes to the aperture design, or to other mechanical properties, in various areas of upper dispensed component 24 may be utilized to affect the relative strain.

Figure 8:
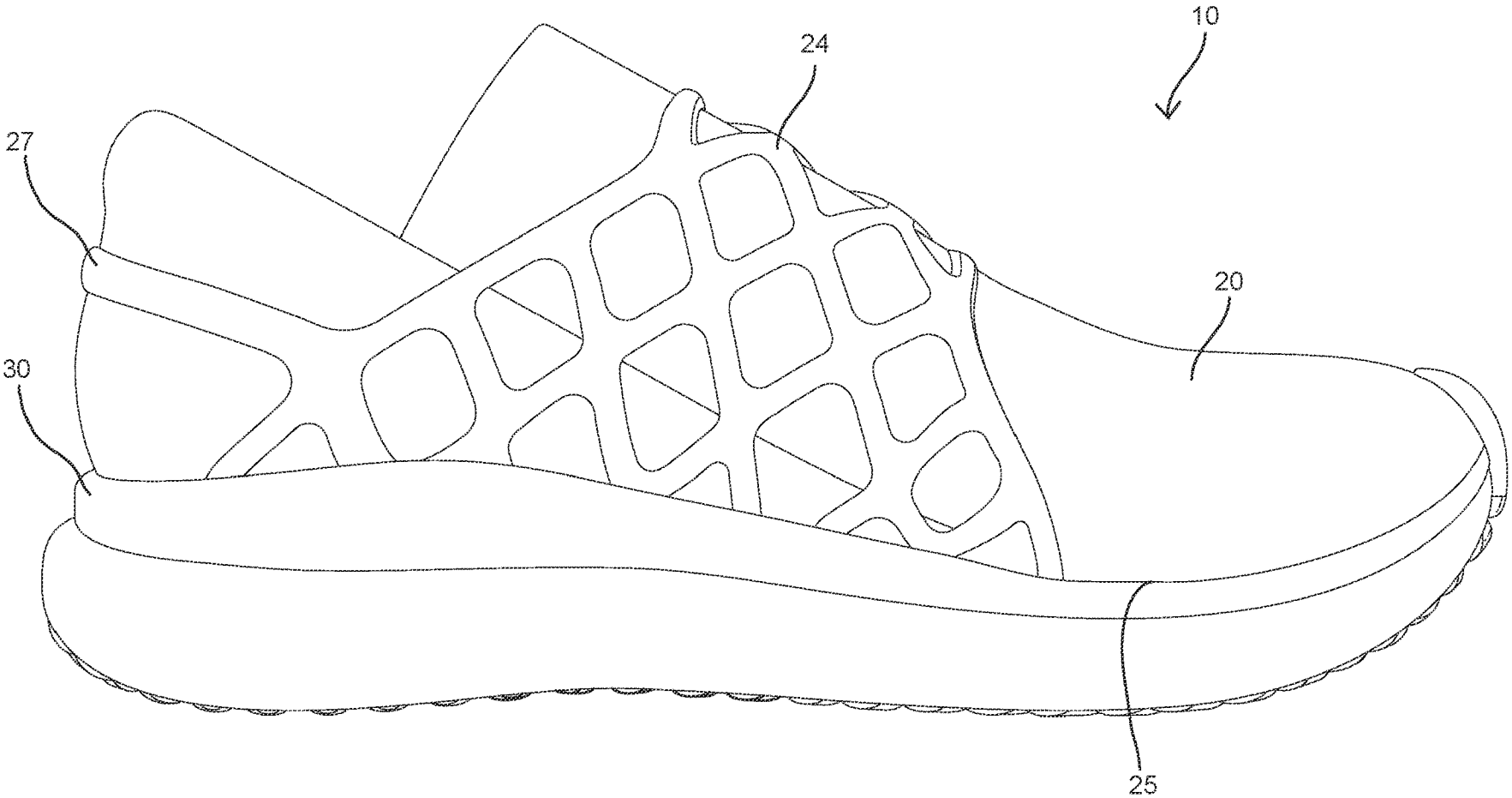
FIG. 8 shows a lateral side view of an article of footwear according to some embodiments.
Figure 9:
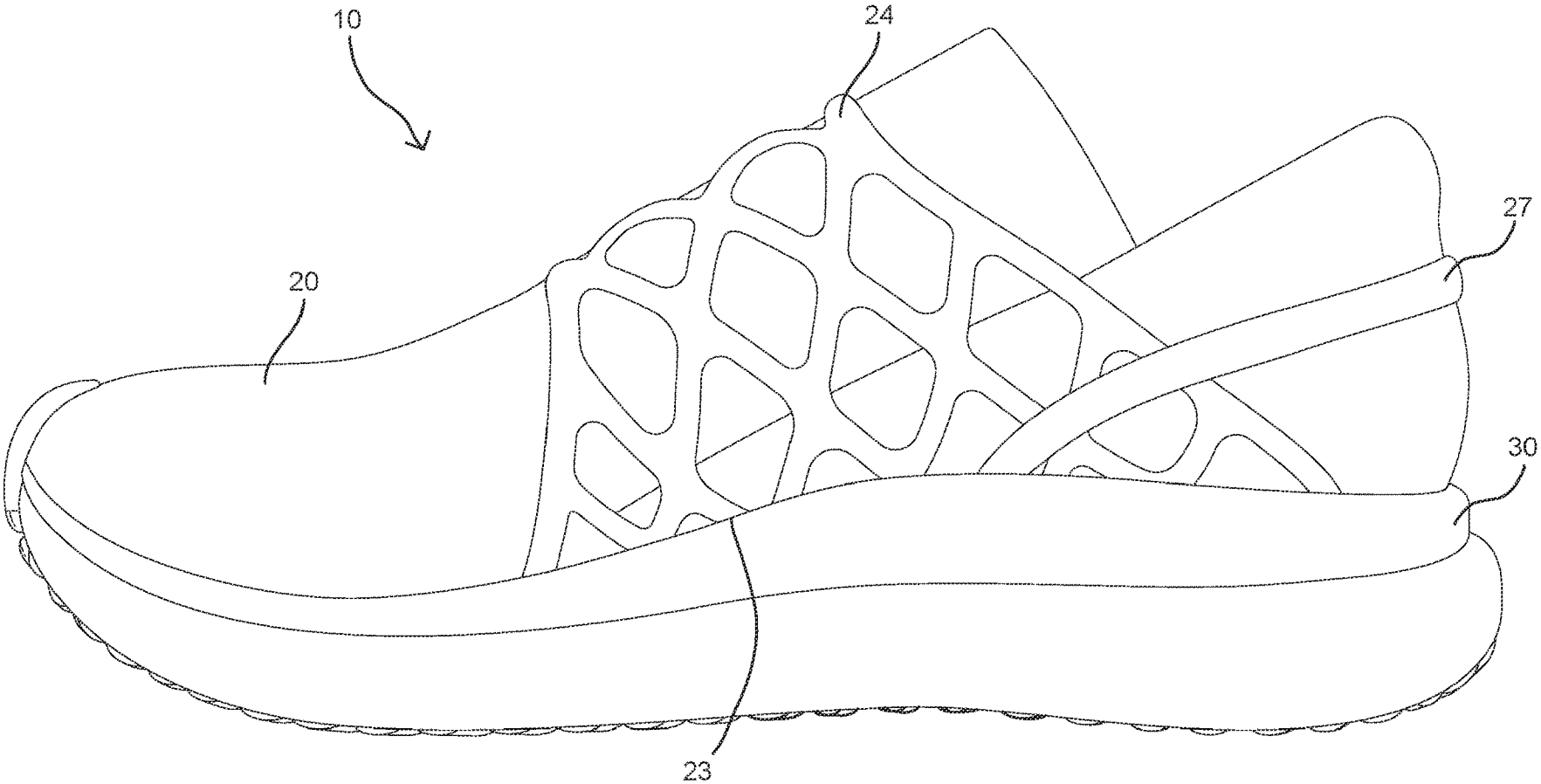
FIG. 9 shows a medial side view of an article of footwear according to some embodiments.

In some embodiments, as shown, for example, in FIGS. 8 and 9, upper 20 includes a strap 27 that extends around the back of the heel of upper 20. In some embodiments, strap 27 is a dispensed component. In some embodiments, strap 27 is made of a non-dispensed material. In some embodiments, strap 27 connects to upper dispensed component 24. For example, strap 27 may be integrally formed with upper dispensed component 24. In some embodiments, strap 27 is attached to medial featherline 23 and/or lateral featherline 25. In some embodiments, strap 27 extends from upper dispensed component 24 on one side of article of footwear 10 (e.g., the lateral side) to the featherline on the other side of article of footwear 10 (e.g., medial featherline 23).

Figure 4:
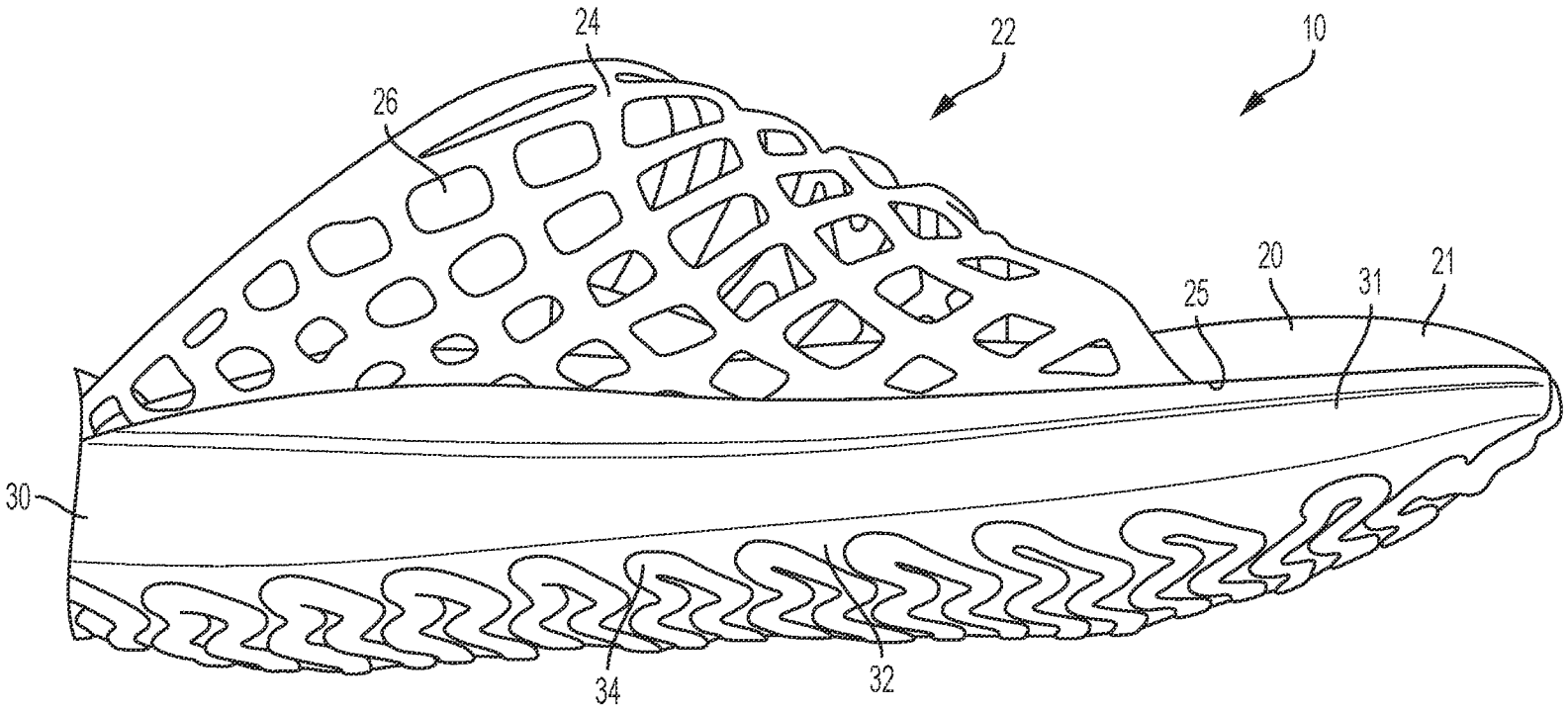
FIG. 4 shows a lateral side view of an article of footwear according to some embodiments.
Figure 5:
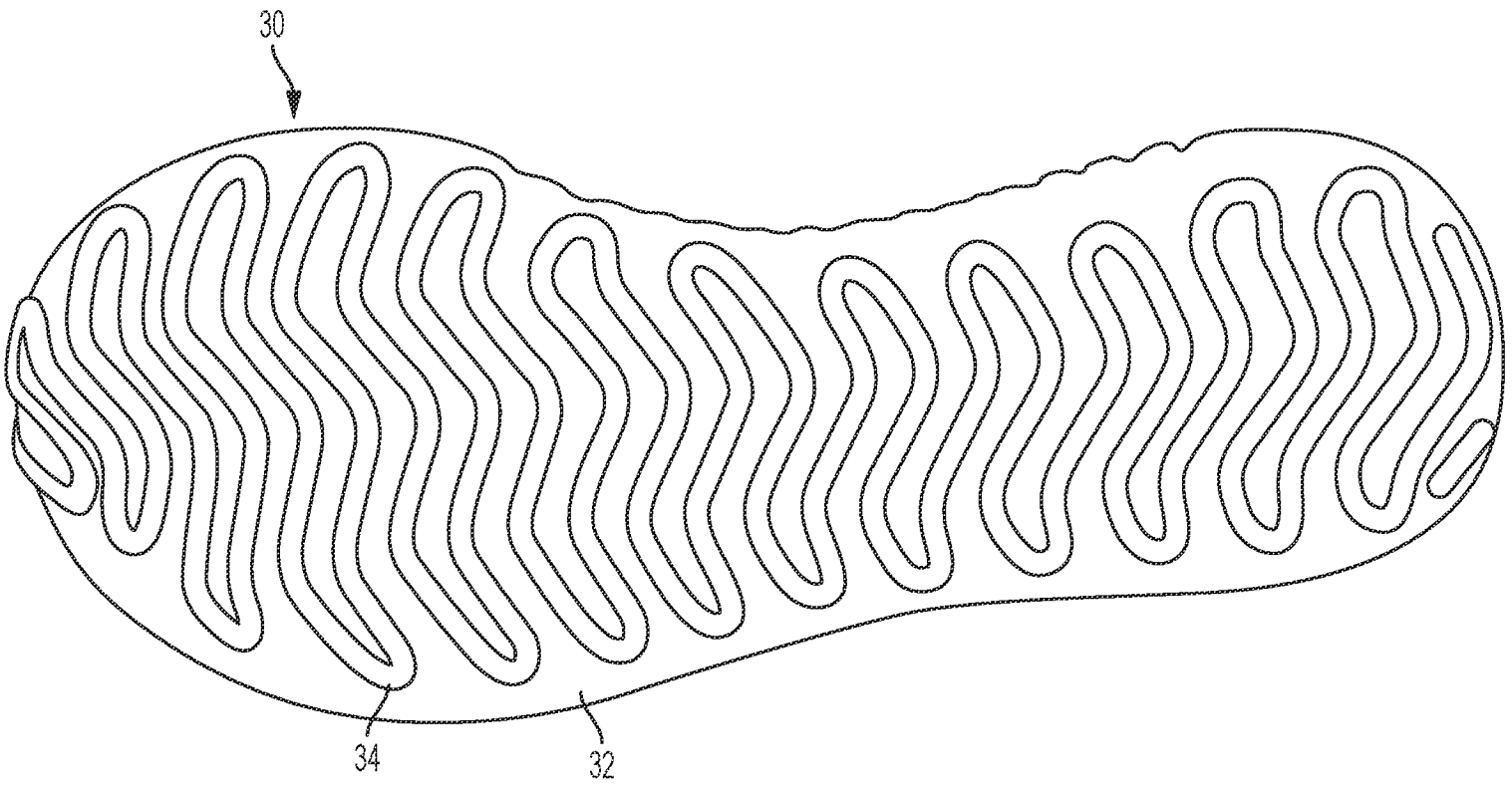
FIG. 5 shows a bottom view of an article of footwear according to some embodiments.
Figure 6:
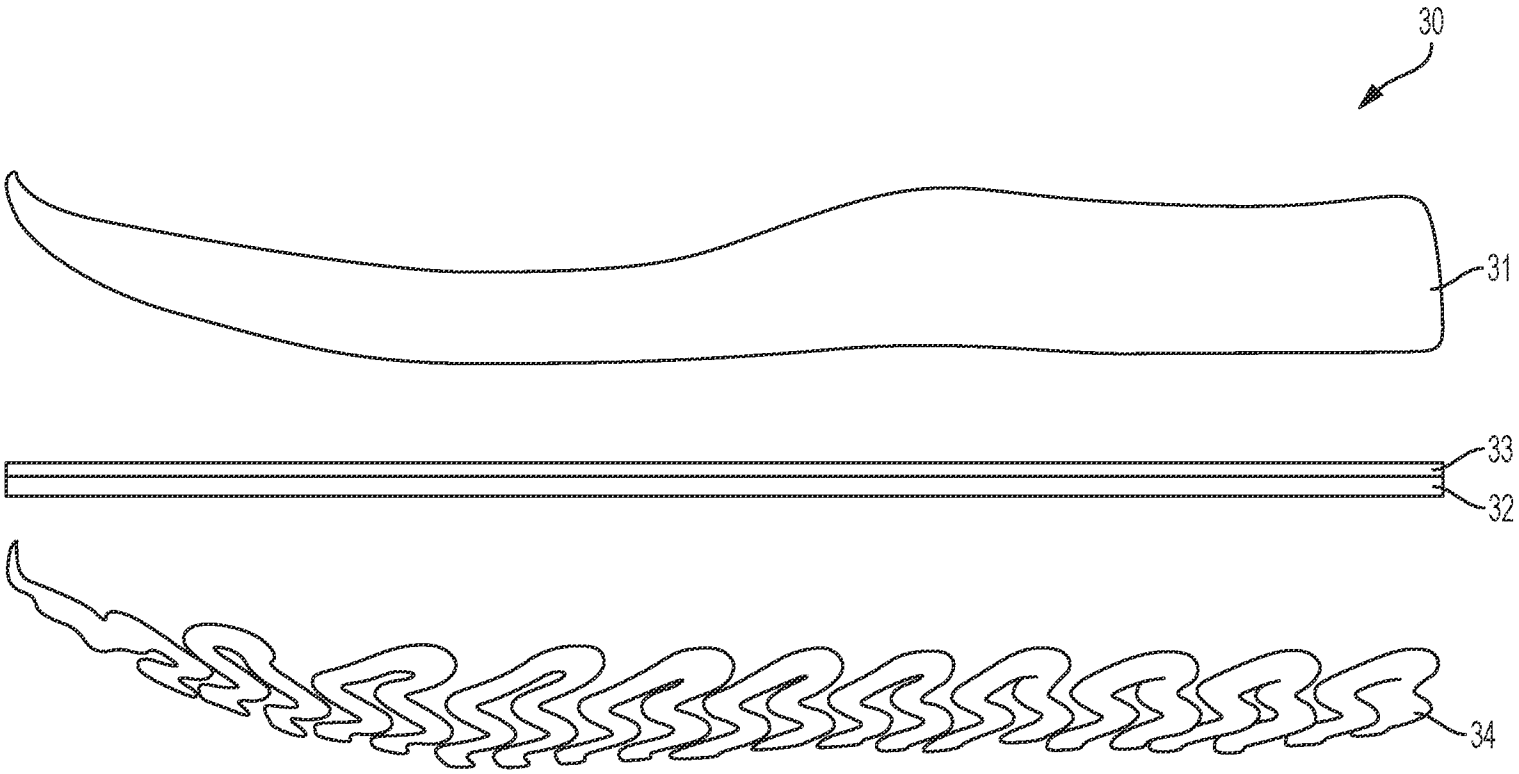
FIG. 6 shows an exploded view of a sole for an article of footwear according to some embodiments.

Details of sole 30 are shown, for example, in FIGS. 4-6. In some embodiments, sole 30 comprises a midsole 31. In some embodiments, sole 30 comprises a substrate 32. In some embodiments, sole 30 comprises sole dispensed component 34. In some embodiments, midsole 31 comprises a foam. In some embodiments, midsole 31 is only made of foam. In some embodiments, substrate 32 is disposed underneath midsole 31. In some embodiments, substrate 32 is attached to midsole 31. In some embodiments, substrate 32 is attached to midsole 31 with an adhesive. In some embodiments, substrate 32 includes a film 33 to facilitate attachment to midsole 31. For example, substrate 32 may include a hot melt film that, with the application of heat, melts and adheres to midsole 31. In some embodiments, substrate 32 is attached to midsole 31 with any type of adhesive system (e.g., solvent-based or water-based urethane cement).

In some embodiments, substrate 32 may be a material that is suitable for bonding with sole dispensed component 34. In some embodiments, substrate 32 includes a synthetic coating. In some embodiments, substrate 32 includes a textile. In some embodiments, substrate 32 includes a textile with a thin film laminate backing or cast film coating. In some embodiments, substrate 32 includes a thermoplastic polyurethane film (e.g., mono-layer film, co-extruded film, multi-layer film) or other suitable polymeric film. In some embodiments, substrate 32 is partially exposed on the bottom surface of sole 30.

In some embodiments, sole dispensed component 34 is dispensed directly onto substrate 32. In some embodiments, sole dispensed component 34 forms an outsole of article of footwear 10. In some embodiments, sole dispensed component 34 may be dispensed in a pattern, such as an undulating pattern back and forth across substrate 32 (e.g., in longitudinal direction 12, a transverse direction, or an angled direction between longitudinal direction 12 and a transverse direction). For example, as shown in FIGS. 5 and 6, sole 30 includes sole dispensed component 34 that extends back and forth in a transverse direction across substrate 32 in an undulating pattern. Sole dispensed component 34 may be dispensed to form a variety of other patterns.

In some embodiments, sole dispensed component 34 is dispensed directly to midsole 31, which may be a traditional midsole foam (e.g., compression-molded EVA, injection-molded EVA, PU foam, TPU film-wrapped PU foam, polyamide foam, polyester-based beaded HR foam, etc.). In some embodiments, sole dispensed component 34 is dispensed directly to blow-molded components of article of footwear 10.

Various embodiments described herein provide an article of footwear that may facilitate a more comfortable fit around the wearer's foot. Further variations of the embodiments described above may also be provided.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A method of manufacturing an article of footwear, the method comprising:

forming an upper dispensed component by dispensing material over an upper for an article of footwear, wherein a bonded segment of the upper dispensed component bonds to the article of footwear, wherein a non-bonded segment of the upper dispensed component does not bond to the article of footwear, and wherein the non-bonded segment is dispensed over a non-stick material that forms a portion of the upper.

2. The method of claim 1, wherein the bonded segment is bonded to the article of footwear at a medial featherline and/or a lateral featherline, and wherein the non-bonded segment extends over an instep of the upper.

3. The method of claim 1, wherein the upper dispensed component is dispensed directly onto the upper.

4. The method of claim 1, wherein the bonded segment of the upper dispensed component bonds to the article footwear as the upper dispensed component hardens.

5. The method of claim 1, wherein the non-stick material is screen printed over a portion of the article of footwear.

6. The method of claim 1, wherein the non-stick material is sprayed over a portion of the article of footwear.

7. A method of manufacturing an article of footwear, the method comprising:

forming an upper dispensed component by dispensing material over a substrate, the substrate comprising a non-stick material that does not bond with the upper dispensed component as the upper dispensed component hardens; and after forming the upper dispensed component over the substrate, attaching the upper dispensed component to an article of footwear such that the upper dispensed component is bonded to the article of footwear at bonded segments of the upper dispensed component and is not bonded to the article of footwear at non-bonded segments of the upper dispensed component.

8. The method of claim 7, wherein the upper dispensed component is bonded to the article of footwear at a medial featherline a and lateral featherline of the article of footwear.

9. The method of claim 7, wherein the upper dispensed component is stitched to the article of footwear.

10. The method of claim 8, wherein the upper dispensed component extends over an instep of an upper for the article of footwear, and the non-bonded segments of the upper dispensed component are not bonded to the instep.

11. The method of claim 7, wherein the upper dispensed component forms a stand-alone component as it hardens over the non-stick material.

12. The method of claim 7, wherein the dispensed component is attached to the article of footwear between an upper and a sole.

13. The method of claim 7, wherein the dispensing of the upper dispensed component is performed automatically by a mechanical device.

14. The method of claim 13, further comprising changing a height of a nozzle of the mechanical device to change the geometry or physical appearance of the upper dispensed component.

15. The method of claim 13, further comprising changing a speed of a nozzle of the mechanical device to change the geometry or physical appearance of the upper dispensed component.

16. The method of claim 7, wherein the upper dispensed component is dispensed to define a plurality of apertures.

17. The method of claim 7, wherein the non-bonded segment allows the upper to stretch and move independently from the upper.

18. The method of claim 7, further comprising dispensing a sole dispensed component onto a substrate of a midsole of the article of footwear.

19. The method of claim 7, further comprising removing the upper dispensed component from the substrate after forming the upper dispensed component over the substrate.

20. The method of claim 7, wherein the substrate is not the article of the footwear.

* * * * *